United States Patent [19]

Scaglione

[11] 4,399,929

[45] Aug. 23, 1983

[54] BOX SPOUT

[76] Inventor: Paul J. Scaglione, 30180 Richmond Hill Dr., Farmington Hills, Mich. 48018

[21] Appl. No.: 286,075

[22] Filed: Jul. 24, 1981

[51] Int. Cl.[3] ..... B67B 7/24

[52] U.S. Cl. ..... 222/81; 222/567; 493/87

[58] Field of Search ..... 222/80, 81, 88, 89, 222/90, 567, 569, 164, 166, 464, 566; 493/87

[56] References Cited

U.S. PATENT DOCUMENTS

| | | | |
|---|---|---|---|
| 2,421,589 | 6/1947 | Wiswell | 222/89 |
| 2,933,218 | 4/1960 | Scaglione | 222/90 |
| 3,314,570 | 4/1967 | Murphy | 222/89 |

*Primary Examiner*—Joseph J. Rolla
*Assistant Examiner*—Charles C. Compton
*Attorney, Agent, or Firm*—Robert G. Mentag

[57] ABSTRACT

A box spout for attachment to a cardboard box, or the like, and further to a method of forming a pouring opening in such a box. The box spout includes an inner wall and an outer wall which are spaced apart and joined at their upper ends. The inner wall is longer than the outer wall and it is provided with longitudinal, converging marginal cutting edges which terminate in a cutting point at its lower free end. The inner wall has a longitudinal, central cutting edge on its outer surface which is perpendicular to the marginal cutting edges. The longitudinal edges of the outer wall converge toward its lower free end. The inner and outer walls are curved in plan cross section. The inner wall is provided with longitudinal ribs between the inner and outer walls for wedging the cardboard wall of a box between the inner and outer walls. The spout has an open upper end and an open rear side. The method of forming a pouring opening in a cardboard box by cutting a substantially horizontal slot in a wall of a box, and a communicating downwardly directed vertical slot. The lower edges of the cardboard wall at the junction of the two slots are then folded inward against the cardboard wall.

7 Claims, 11 Drawing Figures

BOX SPOUT

BACKGROUND OF THE INVENTION

1. Field of the Invention

This invention relates to the box spout art, and more particularly to a novel and improved box spout which is attachable to boxes that are formed of cardboard, or the like. The invention is specifically concerned with a molded plastic box spout that can be quickly and easily attached to a cardboard box, or the like, for dispensing solids or liquids from a box, for example, soap chips or powder, solid foods, milk, and so forth.

2. Description of the Prior Art

It is well known in the box spout art to employ box spouts attachable to boxes formed of cardboard, or the like. An example of a prior art metal box spout is shown and described in U.S. Pat. No. 2,933,218. A disadvantage of the box spout shown in the aforementioned patent is that it is costly to make from metal due to the cost of metal stampings and dies. Further examples of complicated and expensive box pouring spouts are illustrated in U.S. Pat. Nos. 1,456,845; 2,099,322; 2,333,781; 2,510,530; 2,587,716; and 2,613,851.

SUMMARY OF THE INVENTION

In accordance with the present invention, the box spout of the present invention comprises a pouring spout for attachment to a cardboard box, or the like. The invention further comprises a method of forming a pouring opening in such a box. The box spout of the present invention provides an efficient and economical means for dispensing solids or liquids, such as soap chips, powder, solid foods, milk, and so forth, from cardboard boxes and the like. The box spout of the present invention efficiently solves the problem of dispensing the aforementioned items from boxes. Many soap boxes and the like, have premarked opening or pouring areas which state "Press Here", or "Tear Off", and so forth. In the process in trying to follow the opening instructions on such boxes, many fingernails are broken and the opening still is not sufficient whereby the person opening the box then gets a butcher knife or the like, and attempts to enlarge the opening. After the opening is made in the aforementioned manner and pouring commenced, then big globs of soap or other material pours out of the box and causes spillage and waste. The box spout of the present invention overcomes the aforementioned problems and disadvantages of employing the premarked opening areas on soap boxes, and the like, for opening the same.

The box spout of the present invention includes an inner wall and an outer wall which are spaced apart and integrally joined together at their upper ends. The inner wall is longer than the outer wall, and it is provided with longitudinal, converging marginal cutting edges which terminate in a cutting point at its lower, or free end. The inner wall has a longitudinal, central cutting edge on its outer surface which is perpendicular to the marginal cutting edges.

The longitudinal edges of the outer wall converge toward the lower, or free end. The inner and outer walls are curved in plan cross section. The inner wall is provided with longitudinal ribs between the inner and outer walls for wedging the cardboard wall of a box between the inner and outer walls.

The method of forming a pouring opening in a cardboard box comprises, forming a horizontal slot in the wall of a box and a communicating vertical slot, and then folding inwardly the corner portions of the cardboard wall at the junction of the two slots, and maintaining said inward folding of the corner portions.

The box spout of the present invention may be quickly and easily mounted in the wall of a box by positioning the box spout in a horizontal position with its open rear side upwardly, and then pushing the cutting point on the inner wall through the box wall until the free end of the outer wall abuts the wall of the box, whereby a horizontal slot is cut by the cutting edges on the inner wall and a communicating vertical slot is cut by the central longitudinal cutting edge on the inner wall. The box spout is then pivoted upwardly to bring the rear face thereof against the box wall, is then moved downwardly so as to fold inwardly the corner portions or lower edges of the cardboard wall at the junction of the two slots and wedge them between the ribs on the outer side of the inner wall and the inner surface of the outer wall to securely hold the box spout on the box.

Other features and advantages of this invention will be apparent from the following detailed description, appended claims, and the accompanying drawings.

DESCRIPTION OF THE PREFERRED EMBODIMENTS

Figure 1:
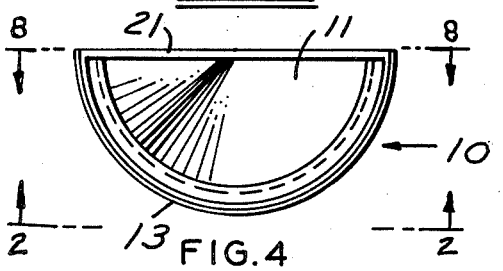
FIG. 1 is a top plan view of the box spout of the present invention.

Referring now to the drawings, the numeral 10 generally designates a box pouring spout made in accordance with the principles of the present invention. As shown in FIGS. 1 through 5, the spout 10 includes an inner wall 11, and an outer wall 12. The spout 10 is preferably made from a suitable plastic material, by any suitable method, as for example, by an injection molding operation. As best seen in FIG. 5, the upper ends of the inner wall 11, and the outer wall 12 are integrally connected together, and a peripheral outwardly extended ridge 13 is formed around the upper end periphery of the outer wall 12 for the reception of a suitable cover, if desired.

Figure 4:
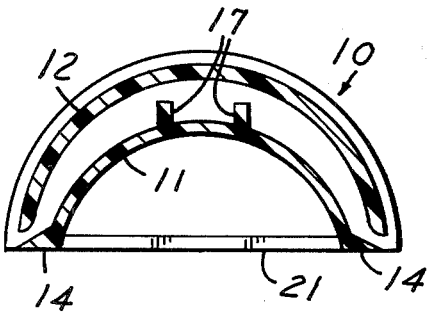
FIG. 4 is an enlarged, horizontal section view of the box spout illustrated in FIG. 2, taken along the line 4—4 thereof, and looking in the direction of the arrows.
Figure 5:
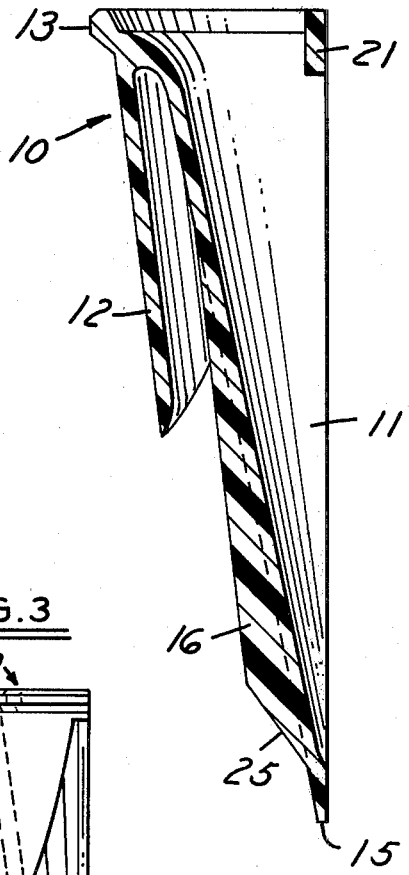
FIG. 5 is an enlarged, elevational section view of the box spout illustrated in FIG. 2, taken along the line 5—5 thereof, and looking in the direction of the arrows.
Figure 3:
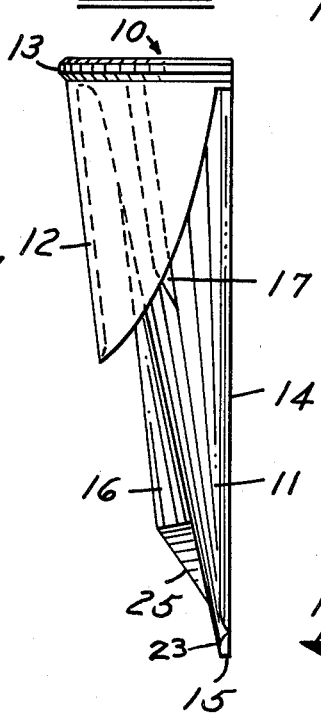
FIG. 3 is a right side elevation view of the box spout illustrated in FIG. 2, taken along the line 3—3 thereof, and looking in the direction of the arrows.
Figure 6:
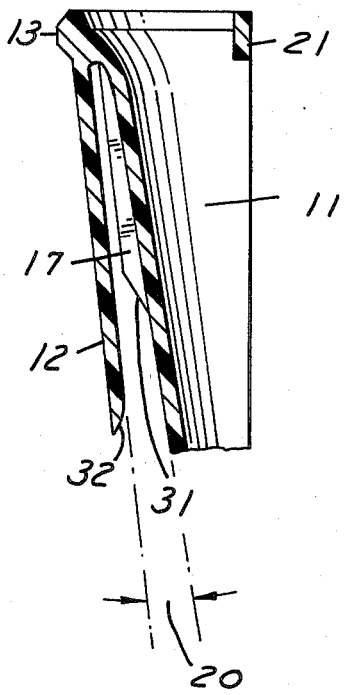
FIG. 6 is a fragmentary, elevational section view of the box spout illustrated in FIG. 2, taken along the line 6—6 thereof, and looking in the direction of the arrows.

As shown in FIGS. 3 and 4, the inner wall 11, and the outer wall 12 are curved in plan cross section, and the curved shape is substantially semi-circular. The spout 10 is open along the rear side thereof, as shown in FIGS. 4, 5, 7 and 8. As shown in FIGS. 1, 5 and 6, the upper end of the spout is also open to provide a pouring or discharge outlet for the spout 10.

Figure 2:
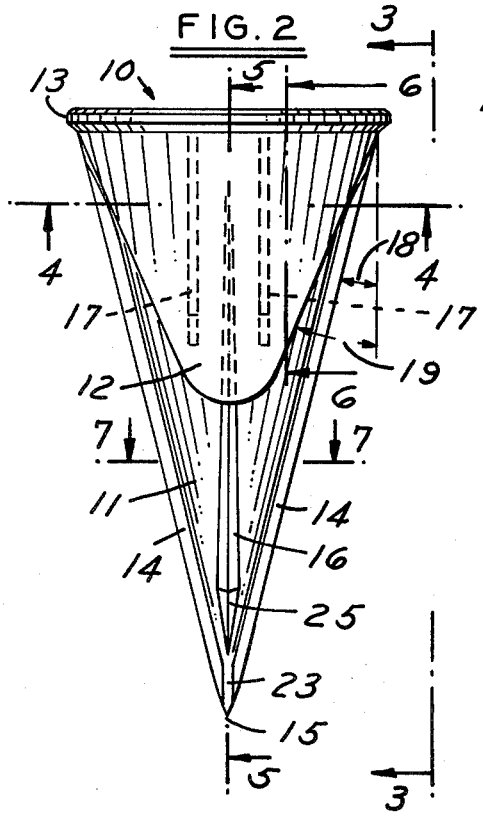
FIG. 2 is a front elevation view of the box spout illustrated in FIG. 1, taken along the line 2—2 thereof, and looking in the direction of the arrows.
Figure 7:
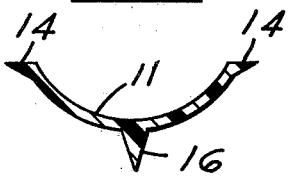
FIG. 7 is an enlarged, horizontal section view of the box spout illustrated in FIG. 2, taken along the line 7—7 thereof, and looking in the direction of the arrows.

As best seen in FIG. 2, the inner wall 11 is longer than the outer wall 12, and it is provided with longitudinal converging marginal side edges which are formed as marginal cutting edges, and indicated by the numerals 14. As shown in FIGS. 2 and 5, the converging marginal cutting edges 14 terminate at their lower end in a cutting point 15. As shown in FIG. 7, the cutting edges 14 have a flat rear face, and when the spout 10 is seated on a horizontal plane, both of the rear faces of the cutting edges 14 will lie flat on said plane.

As shown in FIGS. 2, 5 and 7, the inner wall 11 is provided on the outer surface thereof with a longitudinally extended, centrally disposed cutting edge 16 which is perpendicular to the marginal cutting edges 14. As shown in FIGS. 2, 4 and 6, the inner wall 11 is provided with a pair of laterally spaced apart, longitudinally extended integral ribs 17 which are disposed on opposite sides of the center line of the central cutting edge 16. The ribs 17 extend downwardly from the top end of the inner wall 11 to a point adjacent the lower end of the outer wall 12.

As shown in FIG. 2, the outer wall 12 extends downwardly from its upper end to a point about half of the length of the inner wall 11. The longitudinal edges of the outer wall 12 converge toward its lower or free end in a manner similar to the converging marginal cutting edges 14 of the inner wall 11 which converge towards its lower or free end, or the point 15. The lower end of the outer wall 12 is rounded, as in a semi-circle, as shown in FIG. 2.

As indicated by the numeral 18 in FIG. 2, the angle of convergence from the vertical of each of the inner wall marginal cutting edges 14, is approximately 15°. As indicated by the numeral 19 in FIG. 2, the angle of convergence from the vertical of the edges of the outer wall 12 is approximately 20°. As indicated by the numeral 20 in FIG. 6, the outer wall 12 diverges outwardly from the inner wall 11 at a small angle of divergence of approximately 4°.

Figure 8:
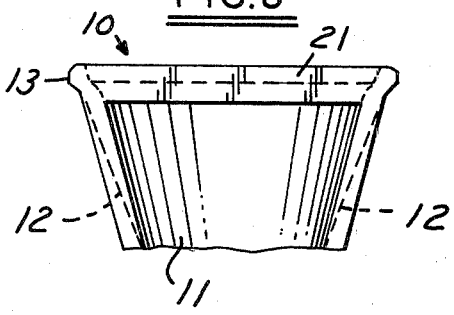
FIG. 8 is a fragmentary, elevational rear view of the box spout illustrated in FIG. 1, taken along the line 8—8 thereof, and looking in the direction of the arrows.

As shown in FIGS. 1, 5 and 8, the spout 10 is provided with a cross or transverse brace bar 21 which extends across the rear upper end of the walls 11 and 12. The cross brace 21 provides structural stability to the spout 10 during the mounting of the spout 10 on a box. The cross brace 21 prevents the walls 11 and 12 from flattening out, and it holds the walls 11 and 12 in a true semi-circular shape. The cross brace 21 also acts as a back-stop for a snap-on cap which the user may wish to employ so that a cap will completely seal the entire top opening of the spout 10. The cross brace 21 also aids in sealing off a box since it presses against the box and creates a seal between the spout 10 and the box wall along the upper end of the spout.

Figure 9:
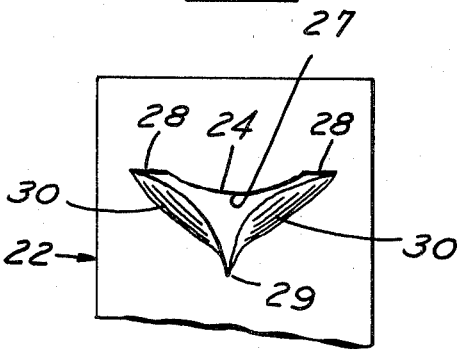
FIG. 9 is side elevation view of a box as slotted, responsive to the first step in an application of the box spout of the invention to a box.

In applying the spout 10 to a box 22, (FIGS. 9–11), the cutting point 15 is placed against the upper end of a side wall of the box with the spout 10 in a horizontal position perpendicular to said wall, and with the open rear side disposed upwardly. Pressure is then exerted on the top end of the spout 10 to force the cutting point 15 through the box wall, and to pierce said wall. The spout 10 is disposed so that the rear flat surfaces of the marginal cutting edges 14 are disposed in a horizontal or transverse plane. The cutting point 15 initially pierces the wall of the box and continued pressure on the spout 10 moves the inner wall 11 through the box wall until the lower end of the outer wall 12 engages the box wall. The last mentioned movement of the spout 10 into the box wall produces an opening in the box wall as shown in FIG. 9. The flat surface 23 of the junction point between the marginal cutting edges 14, adjacent the cutting point 15, initially cuts through the box wall and makes a short cut indicated by the numeral 24 in FIG. 9. Continued inward movement causes the tapered front edge 25 of the central cutting edge 16 to engage the box wall and to initiate a piercing of the same. However, continued inward movement of the spout 10 causes the spout 10 to raise upwardly due to the tapered front edge 25, whereby the marginal cutting edges 14 then move upwardly so as to form a central convex slot 27 with a horizontal slot 28 at each end thereof. The central cutting edge 16 simultaneously cuts a vertical slot 29, and the rounded outer face of the inner wall 11 folds over the box wall corner portions or lower edges of the cardboard wall that are adjacent the intersection of the initial slot 24 and the slot 29, as indicated by the numerals 30 (FIG. 9).

The spout 10 is then pivoted upwardly to bring the rear or smooth faces of the cutting edges 14 on the inner wall 11 against the outer face of the box wall, and such pivoting movement tears the box wall along the line of the center cut 29 and forces the torn box portions 30 outwardly. The spout 10 is then forced downwardly to move the torn box wall portions upwardly between the ribs 17 on the outer side of the spout inner wall 11, and the inner surface of the spout outer wall 12 to securely hold the spout 10 in place on the box wall.

Figure 10:
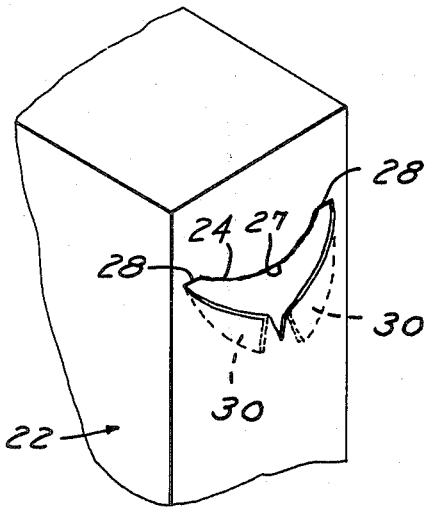
FIG. 10 is a fragmentary, perspective view of the box of FIG. 9, and showing the box as as slotted, torn and folded inwardly, responsive to the second step in the application of the box spout of the present invention to the box.
Figure 11:
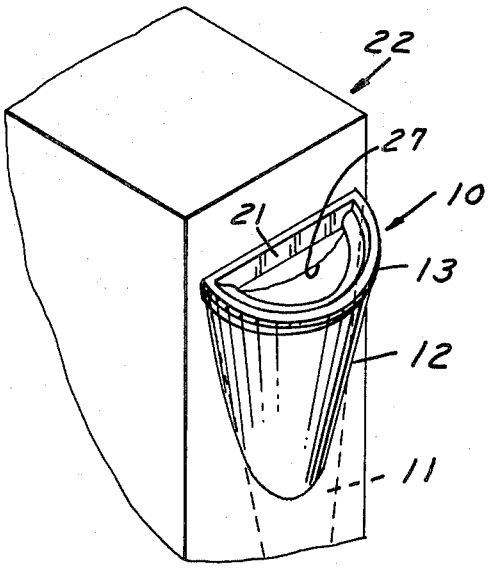
FIG. 11 is a fragmentary, perspective view of a box, showing the box spout of the present invention completely applied to the box.

FIG. 10 shows the hole formed in the box wall when the spout 10 is moved downwardly to the final mounting position shown in FIG. 11. The opening thus made by the mounting of the spout 10 in the box wall is sealed by the tight mounting of the box wall portions between the inner and outer walls of the spout 10, and by the cross brace 21 being positioned against the box wall, above the hole formed through the box wall for admitting the material inside of the box into the open rear end of the spout 10 when the box 22 is tipped to bring the open upper end of the spout 10 into a pouring position.

It will be seen that the central cutting edge 16 provides a center cut 29 which directs the tearing of the box wall along a vertical line when the spout 10 is moved from the horizontal position to the vertical position, and then forced downwardly. The central cutting edge 16 thus assists the tearing of the box wall along the center thereof, along a line perpendicular to the initial transverse line 24 cut by the cutting point 25. The central cutting edge 16 also adds structural strength to the spout 10. The cross sectional shape of the marginal cutting edges 14, as seen in FIG. 7, also adds structural ridgity to the spout 10.

It will be understood that spout 10 of the present invention will work on any side wall of a cardboard box, or the like. The box wall does not necessarily have to have indentations, or a perforated indentation to start the spout 10 into the box wall, or for mounting the spout 10 on the box wall.

The ribs 17 have a sloping front edge 31 which guides the movement of the folded-over portions of the box wall between the spout inner wall 11 and the spout outer wall 12, to position such wall portions securely between the two ribs 17 on the spout inner wall 11, and the inner surface of the spout outer wall 12. It will be understood, that although only two ribs 17 are shown, that any number of ribs 17 may be employed. The ribs 17 thus function to create a wedging effect on the box wall to create frictional resistance between the spout 10 and the box wall, to securely hold the spout 10 in position on the box 22.

As shown in FIG. 6, the outer edge of the outer wall 12 is curved on the inside face thereof, as indicated by the numeral 32. The curved end surface 32 allows for a wide opening at the point where the folded box side wall portions are moved between the spout inner wall 11 and the spout outer wall 12, and to assist upward passage of said box wall portions between the aforementioned ribs 17 and the spout outer wall 12.

The cross brace 21 also provides the spout 10 with structural ridgity and prevents distortion of the spout 10 as mounting forces are applied to the spout 10 during the insertion movement of the spout 10 into the box 22. The cross brace 21 also functions to prevent the spout 10 from spreading or elongating during the insertion process so as to provide a more uniform cutting and tearing into the box 22.

The inner wall 11 is approximately twice as long as the outer wall 12.

While it will be apparent that the preferred embodiment of the invention herein disclosed is well calculated to achieve the results aforestated, it will be appreciated that the invention is susceptible to modification, variation and change.

What is claimed is:

1. A pouring spout attachable to a vertical side wall of a box formed of cardboard or the like for discharging the box contents, characterized in that:

(a) said spout has a pair of spaced apart walls including an inner wall and an outer wall which are integrally joined at their upper ends, and the spout is open on the upper end and along the rear side thereof;

(b) the inner wall is longer than the outer wall and it is provided with longitudinal converging marginal cutting edges which terminate in a cutting point at the lower end thereof;

(c) a longitudinal central cutting edge is formed on the outer surface of the inner wall;

(d) the inner and outer walls extend forwardly in plan cross section;

(e) the longitudinal edges of the outer wall converge toward its lower end;

(f) a plurality of spaced apart longitudinal ribs are mounted on the outer surface of the inner wall; and, (g) the outer wall is disposed in a position diverging downwardly and outwardly from the inner wall, whereby when the cutting point on the spout inner wall is inserted into a vertical side wall of a box in a position perpendicular thereto, and the spout inner wall is moved inwardly into the box until the spout outer wall engages said box wall, a substantial horizontal cut is made in said box wall and a vertical, downwardly extending cut that communicates with the horizontal cut is made in said box wall and the forwardly extended inner wall folds inwardly the lower edge portions of said box wall, along the horizontal cut and on each side of the vertical cut, and then the spout is pivoted upwardly into an abutting relationship with the box wall and said lower edge portions of the box wall are then moved longitudinally between said spout walls, and wedges therebetween by said longitudinal ribs, when the spout is next moved downwardly relative to the box wall.

2. A pouring spout as defined in claim 1, characterized in that:

(a) said inner wall and said outer wall are each arcuately shaped in plan cross section.

3. A pouring spout as defined in claim 2, characterized in that:

(a) the rear faces of said longitudinal, converging marginal cutting edges on the inner wall lie in the same plane.

4. A pouring spout as defined in claim 2, characterized in that:

(a) said inner wall is approximately twice as long as the outer wall.

5. A pouring spout as defined in claim 2, characterized in that:

(a) the longitudinal edges of the outer wall are curved on the inside face thereof to assist the upward wedging passage of said box wall edge portions between said spout walls.

6. The method of forming a pouring opening in a side wall of a box formed of cardboard or the like, comprising the steps of forming a substantially horizontal cut in the side wall of a box and a communicating vertical cut extending downwardly from the horizontal cut, and then folding inwardly the lower edge portions of the box side wall at the junction of the two cuts, and maintaining said inward folding of said box side wall lower edge portions.

7. The method of forming a pouring opening in a side wall of a box as defined in claim 6, including the steps of, applying an outward pressure to the inside of said folded lower edge portions of the box wall, thereby tearing the box wall longitudinally of the vertical cut, and outwardly deflecting the folded box wall lower edge portions at each side of said tear in conjunction with said vertical cut, and maintaining said deflected box wall lower edge portions.

* * * * *